US005395322A

United States Patent [19]

Moser et al.

[11] Patent Number: 5,395,322

[45] Date of Patent: Mar. 7, 1995

[54] BABY FEEDING NIPPLE AND CONDUIT SYSTEM

[76] Inventors: Ramon Moser; Gustavo Moser, both of Av. El Pauji, Edif. Don Daniel, Apt. 1-A, Los Naranjos, El Cafetal, Caracas, Venezuela

[21] Appl. No.: 774,732

[22] Filed: Oct. 9, 1991

Related U.S. Application Data

[63] Continuation of Ser. No. 494,962, Mar. 16, 1990.

[51] Int. Cl.[6] ..... A61J 9/00

[52] U.S. Cl. ..... 604/77; 215/1 A; 215/11.1

[58] Field of Search ..... 604/77, 79; 606/234–236; 215/1 A, 11.1, 11.4; 224/148; 239/33

[56] References Cited

U.S. PATENT DOCUMENTS

| | | | |
|---|---|---|---|
| 42,427 | 4/1864 | Zeno | 215/11.1 |
| 102,417 | 4/1870 | Mason | 215/11.1 |
| 140,518 | 7/1873 | Mayall | 215/11.1 |
| 224,557 | 2/1880 | Potter | 215/11.1 |
| 323,597 | 8/1885 | Prime | 215/11.1 |
| 593,830 | 11/1897 | Borgenschild | 215/11.1 |
| 1,144,980 | 6/1915 | Hilton | 215/11.1 |
| 2,063,424 | 12/1936 | Ferguson | 215/11.1 |
| 2,760,664 | 8/1956 | D'Amico et al. | 215/11.1 |
| 2,989,961 | 6/1961 | Blanchett | 215/11.1 |
| 3,065,873 | 11/1962 | Plate | 215/11.1 |
| 3,165,241 | 1/1965 | Curry | 222/490 |
| 3,323,669 | 6/1967 | Yazaki | 215/11.1 |
| 3,426,755 | 2/1969 | Clegg | 604/77 |
| 3,718,140 | 2/1973 | Yamauchi | 215/11.1 |
| 3,990,596 | 11/1976 | Hoftman | 215/11.1 |
| 4,301,934 | 11/1981 | Forestal | 215/11.4 |
| 4,813,933 | 3/1989 | Turner | 604/79 |
| 4,898,290 | 2/1990 | Cueto | 215/11.1 |
| 5,060,833 | 10/1991 | Edison et al. | 215/1 A |

FOREIGN PATENT DOCUMENTS

| | | | |
|---|---|---|---|
| 11343 | of 1887 | United Kingdom | 215/11.1 |
| 2066795 | 7/1981 | United Kingdom | 215/11.1 |

OTHER PUBLICATIONS

"Juice Nipples"—Product and Packaging Evenflo Products, Co, Ohio ©1989.

*Primary Examiner*—Ralph A. Lewis
*Attorney, Agent, or Firm*—Dennis H. Lambert

[57] ABSTRACT

A baby-feeding nipple and conduit system, comprising a baby-feeding nipple having baby-feeding means on one nipple end for feeding a liquid to a baby and an opposite nipple end and a radially closed conduit having one conduit end for receiving the liquid and an opposite conduit end on the opposite nipple end for supplying the liquid to the nipple.

6 Claims, 4 Drawing Sheets

BABY FEEDING NIPPLE AND CONDUIT SYSTEM

This is a continuation of copending application Ser. No. 07/494,962 filed on Mar. 16, 1990.

BACKGROUND OF THE INVENTION

The invention relates to a baby-feeding nipple and conduit system and, more particularly, to a stretchable nipple and conduit system by which a container that supplies liquid to the conduit and nipple for a baby does not have to be in close, elevated proximity to the baby's mouth.

Known baby-feeding nipple systems have a baby-feeding nipple, a container for a liquid to be fed to the baby, and an arrangement for connecting the nipple directly to the container. Such systems have several disadvantages. The container has to be held right in front of the baby's face in order for the nipple to reach the baby's mouth, which promotes continuous feeding of the baby, instead of intermittent, continual feeding that is at least sometimes preferable. The container also has to be kept at an angle above the baby's mouth, which promotes awkward positions for the baby or system, so that the nipple continuously receives liquid to prevent feeding the baby air bubbles from the container, which is undesirable. In order to hold the container at the baby's face at the elevated angle, continual physical participation by the baby's attendant is made necessary at least by the baby's movement, which is undesirable. Finally, in most instances, the liquid to be fed to the baby has to be transferred from its source to the container that receives the baby-feeding nipple, which can be inconvenient, particularly in public.

SUMMARY OF THE INVENTION

An object of the invention is, therefore, to provide a baby-feeding nipple and conduit system that relieves the disadvantages of the known systems.

To this and other ends, the baby-feeding system of the invention has structure for feeding a liquid to a baby, through a tip end of a nipple and a radially closed conduit having one end for receiving a liquid to be fed to the baby and an opposite end connected to an opposite or base end of the nipple. The conduit may be integral with the nipple or connected to the base end of the nipple in a known way, or by a sliding seal.

Preferably, the base end of the nipple has structure that is diametrically stretchable for effecting a sliding seal about a conduit that is diametrically rigid relative to the diametric stretchability of the connection structure. (The foregoing definition of the diametric rigidity of the conduit is intended herethroughout.) The conduit should have a longitudinally smooth external surface for the sliding seal with the diametrically stretchable base end of the nipple.

Preferably, too, the conduit is elongated, so that one end can be immersed in a liquid in a container that is remote from a baby's mouth. The elongated conduit is preferably transversely flexible to accommodate varying orientations between the baby's mouth and the container for the liquid to be fed to the baby through the conduit and nipple including, therefore, having the container below the nipple and baby's mouth. Although conduit materials that are both diametrically rigid and transversely flexible are contemplated, it is also possible for only the opposite end of the conduit to be diametrically rigid for facilitating the flexibility of the remaining portion of the conduit that extends to the liquid.

A further preferred embodiment has a base member of flange that has a larger diameter than the nipple about the base end of the nipple for preventing the nipple from entering too far into the baby's mouth. The base member may also limit, reinforce, and shape the diametric stretchability of the opposite end of the nipple about the conduit. Particularly in conjunction with the base member, therefore, the diametric stretchability of the opposite end of the nipple contemplates only variation in the internal diameter of the opposite end of the nipple, whether by actual stretching of the nipple material, radial compression of the nipple material, longitudinal displacement of the nipple material away from the base member, or any combination thereof.

A still-further preferred embodiment additionally has a check valve for preventing liquid flow away from the nipple at least when the nipple is not feeding the liquid to the baby. The check valve may be in the nipple or conduit, but preferably, it is in the tip end of the nipple. In the latter case, the check valve may comprise at least one and preferably more radially arranged slits through an elastomeric material from which at least the tip end of the nipple is made. Particularly in the last case, where one end of the nipple is elastomeric and the opposite end of the nipple is diametrically stretchable, it is contemplated that the entire nipple is made from an elastomeric, stretchable material.

Needless to say, because a baby-feeding nipple system is contemplated, all the components of the nipple system are preferably hygienically cleanable and non-toxic in combination with liquids that may be fed to a baby or if ingested. Materials with all of the rigidity, flexibility, stretchability, elastomeric, hygienic, non-toxic, size and other properties described above are known.

BRIEF DESCRIPTION OF THE DRAWING

Preferred embodiments, which illustrate, but do not limit the invention, will now be described with reference to a drawing, in which.

DESCRIPTION OF THE PREFERRED EMBODIMENTS

Figure 1:
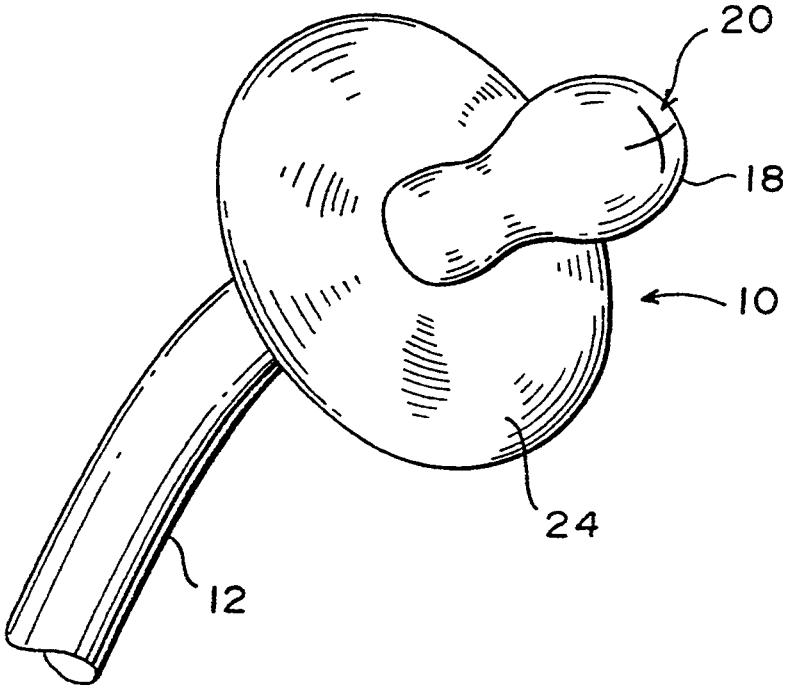
FIG. 1 is a nipple-end perspective view of a nipple-end portion of one preferred embodiment.
Figure 2:
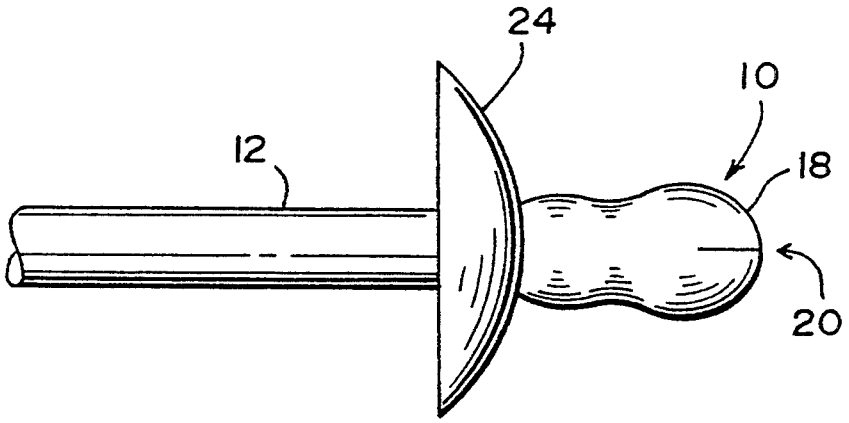
FIG. 2 is a longitudinal side elevation of the embodiment of FIG. 1 with the conduit portion thereof in a different position.

As shown in FIGS. 1 to 5, a nipple system at 10 for feeding a baby (not shown) is in combination with a conduit 12 for conducting a liquid 14 (FIG. 5) from a container 16 (FIG. 5) to the baby's mouth at the nipple system. As shown particularly in FIGS. 1, 4 and 5, the conduit is a preferably flexible, cylindric, plastic tube having a smooth outer surface. The flexibility of the conduit 12 permits the nipple system at 10 to be in various orientations relative to the container 16 and remote from the container 16.

The nipple system at 10 has a hollow nipple 18 which is made from a stretchable, elastomeric material, such as rubber, for example. One end (the tip end) of the nipple for feeding the liquid to the baby has a pair of crossed slits at 20. The opposite base end of the nipple has a radial flange 22 (FIGS. 3 and 4) which defines an opposite-end portion of the nipple that forms a sliding seal about the opposite end of the conduit 12 that does not extend into the container 16.

The flange 22 also provides a structure that holds a base member 24 onto the end of the nipple opposite the baby-feeding slits at 20. The nipple is preferably larger in diameter toward the slit end than at the opposite end with the flange 22, so that the base member 24 cannot readily come off of the nipple toward the slit end, either. Although, it could be achieved with other methods live, for example, with another, flange-like ring in this side of the base. The base member 24 is preferably made from a semi-rigid plastic to reinforce and define the sliding seal between the flange end of the nipple and the conduit. The base member 24 also has a diameter sufficiently larger than that of the nipple 18 to prevent the nipple from entering too far into a baby's mouth. As a result, a baby cannot swallow the nipple system if it slides off the conduit in use.

Figure 4:
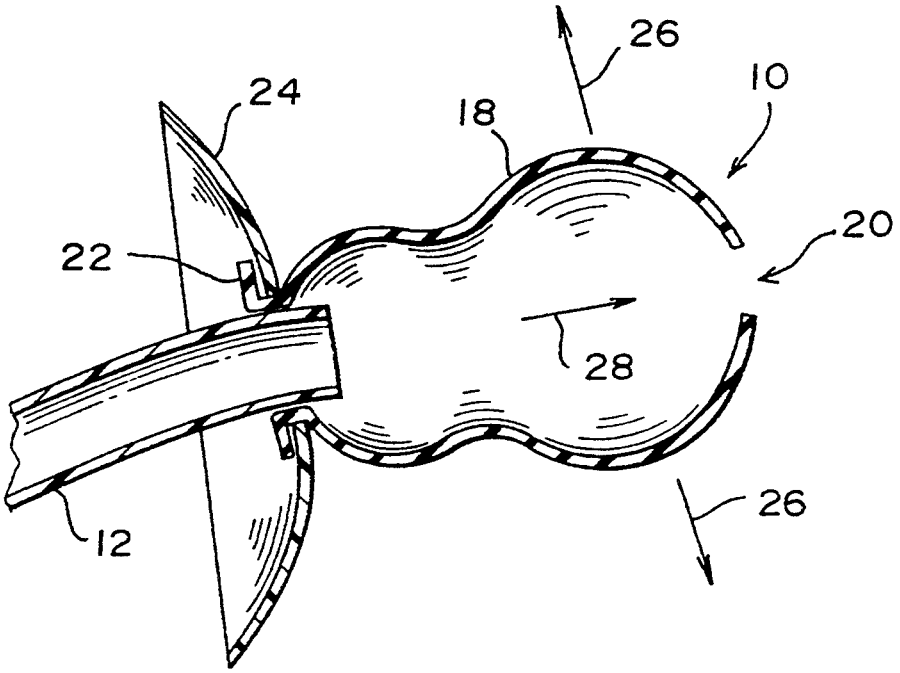
FIG. 4 is an enlarged, longitudinal cross-sectional, view of the embodiment of FIG. 2 showing the slits in the tip end in an open position.

In use, the nipple system at 10 is inserted into a baby's mouth. When the baby then sucks on the nipple, the nipple is flexed, for example by being compressed perpendicularly to the plane of FIG. 4. Such compression results in perpendicular expansion as indicated by the arrows 26 in FIG. 4. The perpendicular expansion opens a slit having a direction that crosses the direction of the expansion, which is assured for every direction by the crossed slits. A slit so opened is also indicated in FIG. 4 and permits liquid to pass to the baby in the direction of the arrow 28 in FIG. 4. (It may have been helpful for this, particularly if the conduit 12 is long, to have had an attendant fill the conduit and nipple with liquid from the container first.)

Figure 3:
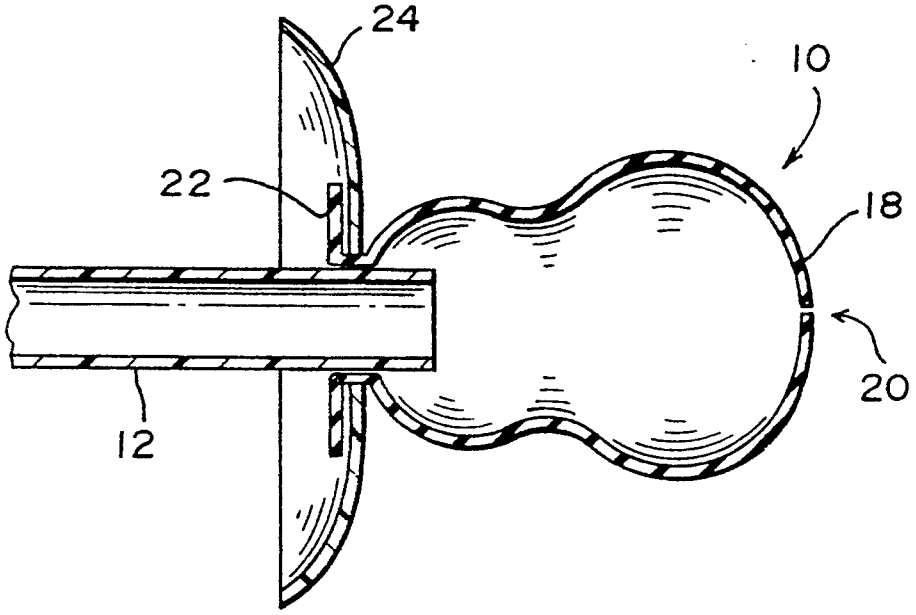
FIG. 3 is an enlarged, longitudinal cross-sectional, view of the embodiment of FIG. 2.

When the baby stops sucking on the nipple, the elastomeric property of the nipple closes the slit from the open position as shown in FIG. 4, to a closed position as shown in FIG. 3. The closed slit then acts as a check valve to prevent air from entering the nipple through the slit and, thus, prevent liquid from moving away from the slit end of the nipple. Liquid thus remains available in the nipple and conduit for again feeding the baby when the baby again sucks on the nipple to reopen the slit as shown in FIG. 4.

Figure 6:
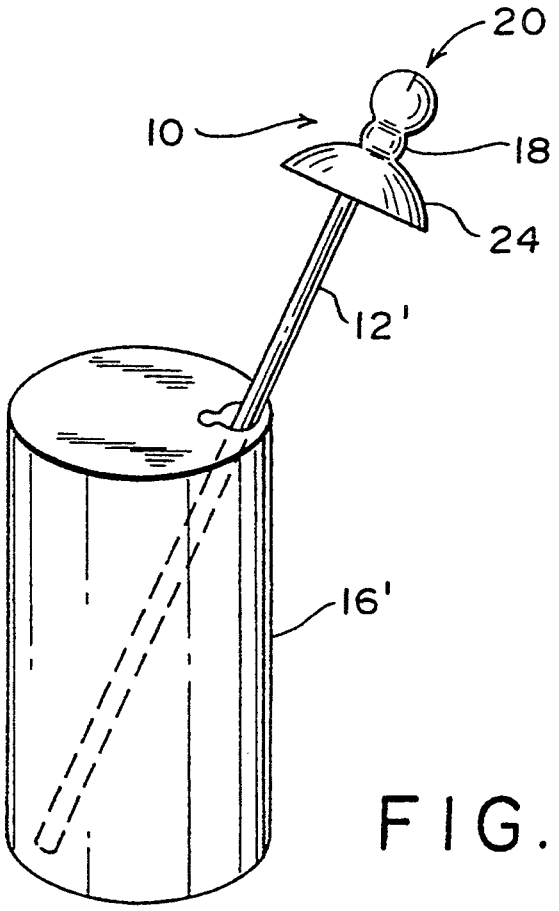
FIG. 6 is a perspective view of another embodiment, together with another container for a liquid (not shown) to be fed to a baby.

The sliding seal at the opposite or base end of the nipple at the flange 22 about the conduit 12 permits the nipple system at 10 to be used (or re-used, preferably after hygienic cleaning) on a conduit 12' (FIG. 6) that is different from that of the preceding Figures. The conduit 12' is longitudinally rigid, like an ordinary paper or plastic soda straw, for example. A different container 16' of liquid to be fed to a baby can then be purchased in public, for example, together with a soda straw from which an adult would drink the liquid from the container, and the nipple system at 10 sealed slidingly onto an end of the straw projecting from the container for feeding the liquid, instead, to a baby.

Figure 5:
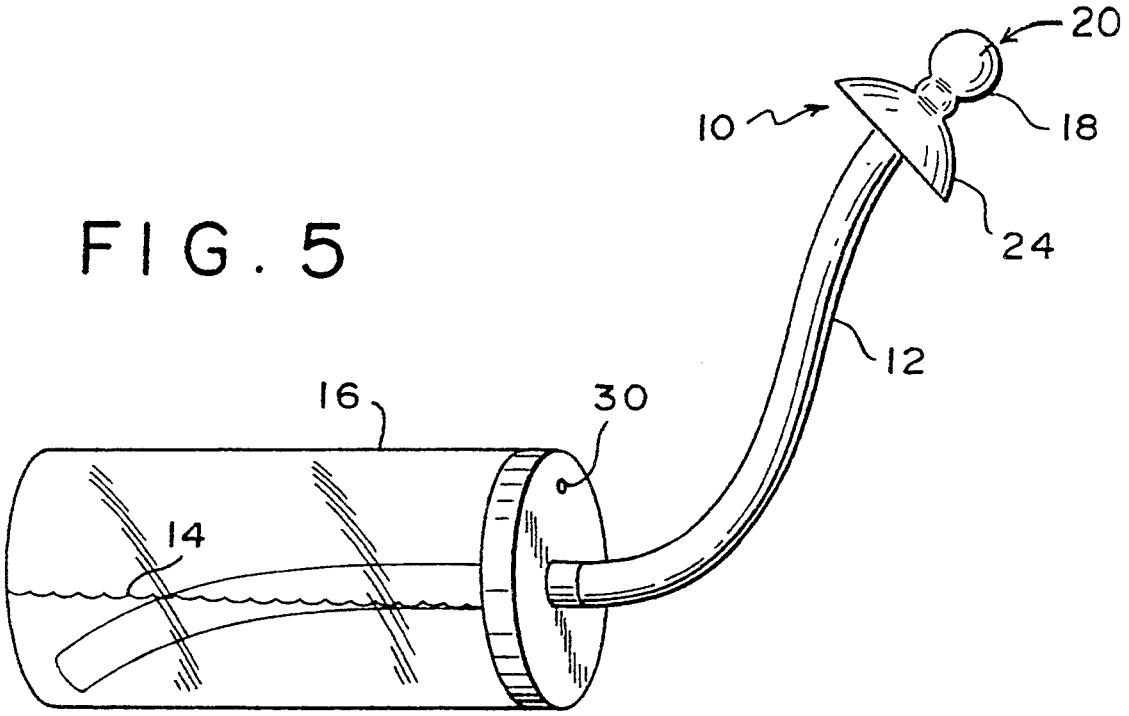
FIG. 5 is a perspective view of the embodiment of FIG. 1, together with a partly transparent container for a liquid to be fed to a baby.

In the latter instance, the soda straw does not seal the container, so that air can replace liquid fed to the baby. If the container is closed about the conduit as shown in FIG. 5, however, the container closure may be provided with a non-spill vent 30 for such air replacement. Non-spill vent devices for this are known. The closure and vent of the embodiment of FIG. 5, together with the flexibility of the conduit 12 thus permits greater flexibility of placement of the container relative to the baby's mouth on the nipple system.

Figure 7:
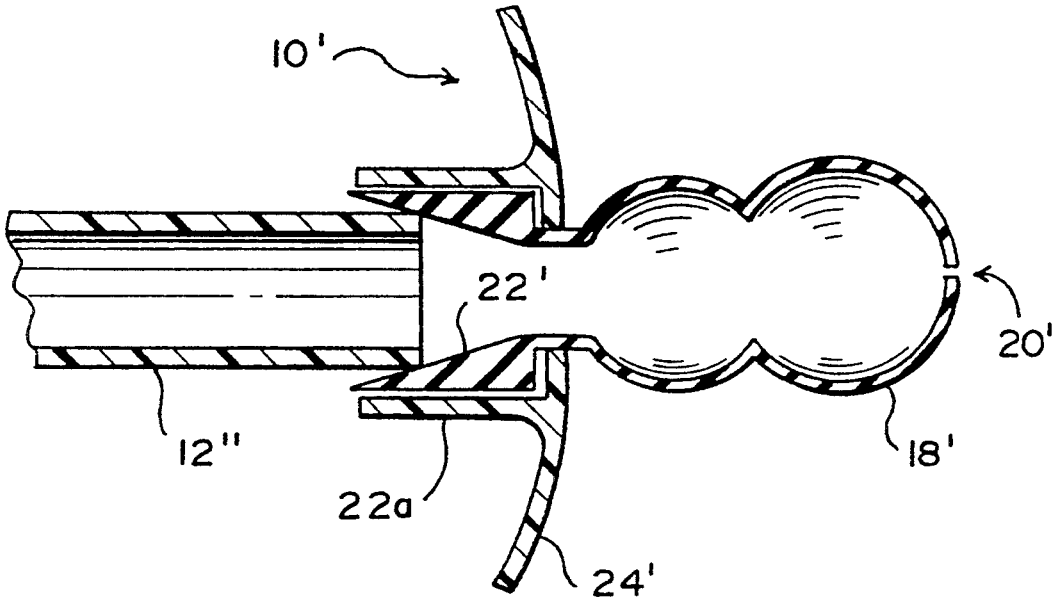
FIG. 7 is an enlarged, longitudinal cross-sectional view of a nipple-end portion of another embodiment.
Figure 8:
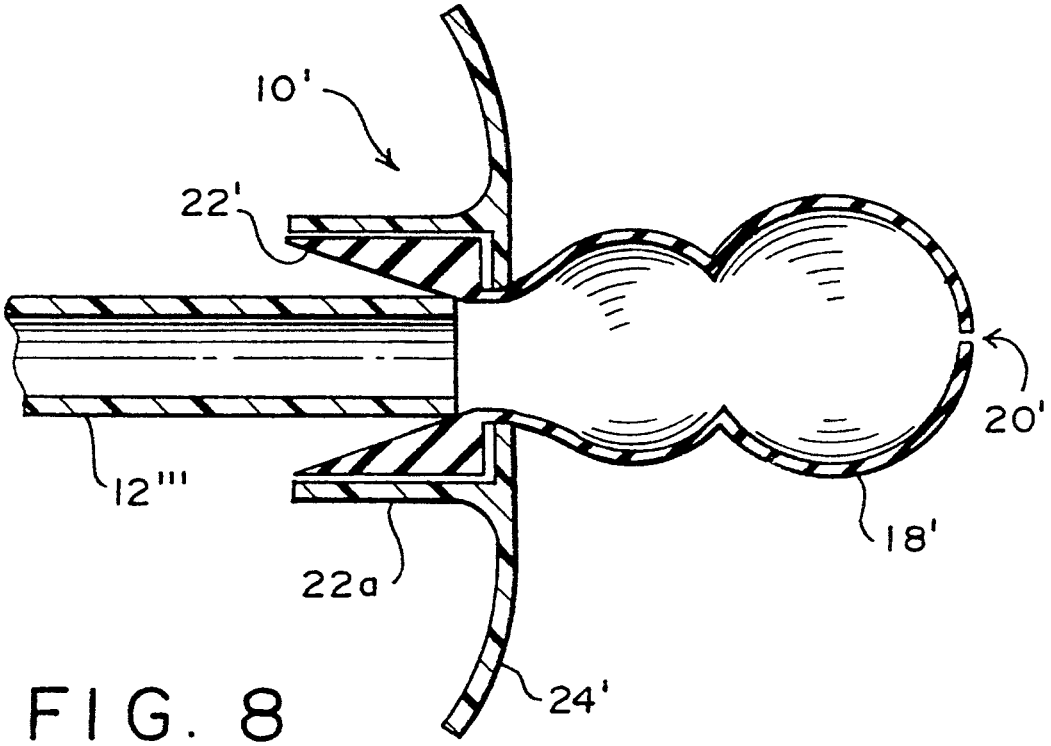
FIG. 8 is an enlarged, longitudinal cross-sectional side elevation of a nipple-end portion of another embodiment.

The embodiment of FIG. 7 is substantially the same as those previously described, and thus correspondingly referenced, with primes. The flange 22', however, has substantial longitudinal length and a conical interior surface that converges toward the one end of the nipple 18' with the slits at 20' (only one shown). The base member 24' has a longitudinal, cylindrical wall **22*a* to support the flange 22' radially. This flange and wall structure slidingly seals about a large-diameter conduit, as shown in FIG. 7, or a small diameter conduit, as shown in FIG. 8**. This embodiment is now particularly preferred, therefore.

Other embodiments and uses of the nipple and conduit system described above as would occur to those of ordinary skill in the art are contemplated as within the scope of the invention defined by the following claims.

We claim:

1. A feeding system for infants, comprising, in combination:

a flexible nipple having a tip end and a base end, said nipple having a longitudinal axis and a transverse axis, and a transversely extending flange on the base end to prevent swallowing of the nipple by the infant;

said tip end of the nipple having normally closed slits therein defining one-way check valve means for flow of liquid from the nipple in response to sucking action on the nipple by an infant, and operable to prevent leakage of liquid from the nipple and ingress of air into the nipple when an infant is not sucking on the nipple, whereby said check valve means prevents ingress of air into the nipple when sucking action on the nipple ceases and the elevation of liquid in the container is lower than the elevation of the tip end of the nipple, so that liquid that has been drawn into the conduit and nipple will not drain therefrom, regardless of the position of the container or elevation of liquid therein relative to the elevation of the nipple, enabling an infant to drink from a container that is in any position relative to the infant and insuring that liquid remains in the nipple and conduit to prevent ingestion of air by the infant at times when nursing is stopped and then restarted;

said base end of the nipple having a reduced diameter internal opening extending longitudinally therethrough for receiving a tubular conduit to supply liquid to the nipple in response to sucking action on the nipple;

an elongate tubular conduit having a first diameter and having one end removably received in the opening in the base end of the nipple and sealed relative thereto, said conduit having another end adapted to extend into a container of liquid to be supplied through the conduit to the nipple and fed through the nipple to an infant; and said opening in the base end of the nipple having a larger diameter at an outer end thereof and a smaller diameter at an inner end so that said conduit may be removed and any one of a plurality of conduits having a range of different diameters can be received and sealed in said opening.

2. A feeding system for infants as claimed in claim 1, wherein:

said conduit and nipple are sealed and connected to one another at the base end of the nipple by a sliding seal between the nipple and conduit, whereby the nipple and conduit may be separated from one another for cleaning and sterilization and to permit the nipple to be applied to different conduits.

3. A feeding system for infants as claimed in claim 1, wherein:

the transverse flange is formed on a separate base member applied to the base end of the nipple, said base member comprising a rigid material.

4. A feeding system for infants as claimed in claim 1, wherein:

the conduit is flexible in a transverse direction so that it may be flexed into different orientations relative to a container with which it is associated.

5. A feeding system for infants as claimed in claim 1, wherein:

the opening in the nipple base end is tapered from its outer end to its inner end for sealing engagement with different diameter tubular conduits inserted into the opening.

6. An infant feeding device, comprising:

a flexible nipple adapted to be connected with a source of liquid and held in the mouth of an infant and sucked on to obtain liquid from the source, said nipple having a longitudinal axis extending from a base end to a tip end thereof;

said nipple having a passage means through the tip end thereof for flow of liquid from the nipple in response to sucking action on the nipple by an infant, when the nipple is connected with a source of liquid; and said base end having a reduced diameter opening extending longitudinally therethrough from an outer end to an inner end, for attachment of an elongate tubular conduit that is adapted to be received at one end thereof in said opening and adapted to be received at its other end in a container holding said source of liquid, said opening having a predetermined length that tapers from a first diameter at its outer end to a second, smaller diameter at its inner end, whereby the tapered opening is adapted to receive and hold any one of a plurality of conduits of different diameters.

* * * * *